US005902163A

United States Patent [19]

Baruzzi et al.

[11] Patent Number: 5,902,163

[45] Date of Patent: May 11, 1999

[54] DEBRIS SHEDDING BUOY

[75] Inventors: Giovanni Baruzzi, Caracas, Venezuela; Stephen E. Trenchard, Houston, Tex.

[73] Assignee: Automatic Power, Inc., Houston, Tex.

[21] Appl. No.: 08/854,196

[22] Filed: May 9, 1997

[51] Int. Cl.[6] ..... B63B 22/18

[52] U.S. Cl. ..... 441/23; 441/22; 441/6; 441/1

[58] Field of Search ..... 441/1, 6, 11–13, 441/16, 21–23, 136

[56] References Cited

U.S. PATENT DOCUMENTS

| | | | |
|---|---|---|---|
| 194,126 | 8/1877 | Cabell | 441/22 |
| 388,384 | 8/1888 | Woodworth . | |
| 846,567 | 3/1907 | Hill . | |
| 1,066,636 | 7/1913 | MacGenn . | |
| 1,067,113 | 7/1913 | Heyn . | |
| 3,093,107 | 6/1963 | Grand et al. | 441/12 |
| 4,896,620 | 1/1990 | Jones | 441/23 |

*Primary Examiner*—Ed L. Swinehart
*Attorney, Agent, or Firm*—Panitch Schwarze Jacobs & Nadel, P.C.

[57] ABSTRACT

A debris shedding buoy having a float body with a top and a bottom is provided. The buoy includes a slide rail, adapted for slidable engagement to a mooring line, is attached to the bottom of the float body. The slide rail is located in a generally centered position beneath the float body and is oriented in a first direction. A rudder device is affixed to the float body and adapted to produce a stabilizing force to maintain the float body in a quasi stable orientation with respect to a current direction, with the first direction being generally aligned to the current direction. Debris lodging against the float body overcomes the stabilizing force produced by the rudder device, causing the float body to rotate from the quasi stable orientation to a second orientation to shed the debris whereupon the float body rotates back to the quasi stable orientation.

9 Claims, 3 Drawing Sheets

DEBRIS SHEDDING BUOY

FIELD OF THE INVENTION

The present invention relates to marker buoys and more particularly to a marker buoy which sheds floating debris.

BACKGROUND OF THE INVENTION

Marker buoys for marine use are generally known. Such buoys often include a marker beacon and/or a bell and are commonly used to mark navigable channels or unseen underwater hazards.

One known buoy includes a float having a super-structure which extends above the water line of the buoy. A bell is attached to the super structure. A pair of fins are attached beneath the float. The first fin orients the float in the direction of the current, and the second fin, which is set at an angle from the first fin, causes the buoy to swerve from side to side and off its center of gravity to incline the float and super structure carrying the bell. An anchor line maintains the buoy in position. The movement of the buoy is sufficient to throw the clapper of the bell off center, causing a constant ringing of the bell.

Another known buoy includes a near spherical body with a central battery space for a battery. A light assembly is affixed to a mast which extends upward from the body, and is connected to the battery. An eye is provided at the lower end of the spherical body and connected to an anchor chain.

Another known buoy includes a buoyant body with a tow bar assembly located on the side of the body. A mast extends upwardly from the buoyant body and a light is affixed to the top of the mast. An eye at the end of a control line is slidably disposed on the tow bar and when the control line is pulled, the eye slides upwardly along the tow bar until it engages a bight, allowing the buoy to be moved sideways through the water while remaining substantially upright.

A common problem with all of the known buoys is that debris carried by the current can become lodged against the buoy, which can be detrimental to the buoy. If enough debris collects it can break the buoy loose from its mooring, possibly submerge the buoy or otherwise adversely affect its function.

The present invention is a result of observation of the shortcomings of the prior art buoys and efforts to solve them.

SUMMARY OF THE INVENTION

Briefly stated, the present invention is a debris shedding buoy comprising a float body having a top and a bottom. A slide rail, adapted for slidable engagement to a mooring line, is attached to the bottom of the float body. The slide rail is located in a generally centered position beneath the float body and is oriented in a first direction. A rudder device is affixed to the float body and adapted to produce a stabilizing force to maintain the float body in a quasi stable orientation with respect to a current direction, with the first direction being generally aligned to the current direction. Debris lodging against the float body overcomes the stabilizing force produced by the rudder device, causing the float body to rotate from the quasi stable orientation to a second orientation to shed the debris whereupon the float body rotates back to the quasi stable orientation.

BRIEF DESCRIPTION OF THE DRAWINGS

The foregoing summary, as well as the following detailed description of preferred embodiment of the invention, will be better understood when read in conjunction with the appended drawings. For the purpose of illustrating the invention, there is shown in the drawings an embodiment which is presently preferred. It should be understood, however, that the invention is not limited to the precise arrangements and instrumentalities shown. In the drawings.

DETAILED DESCRIPTION OF PREFERRED EMBODIMENTS

Figure 1:
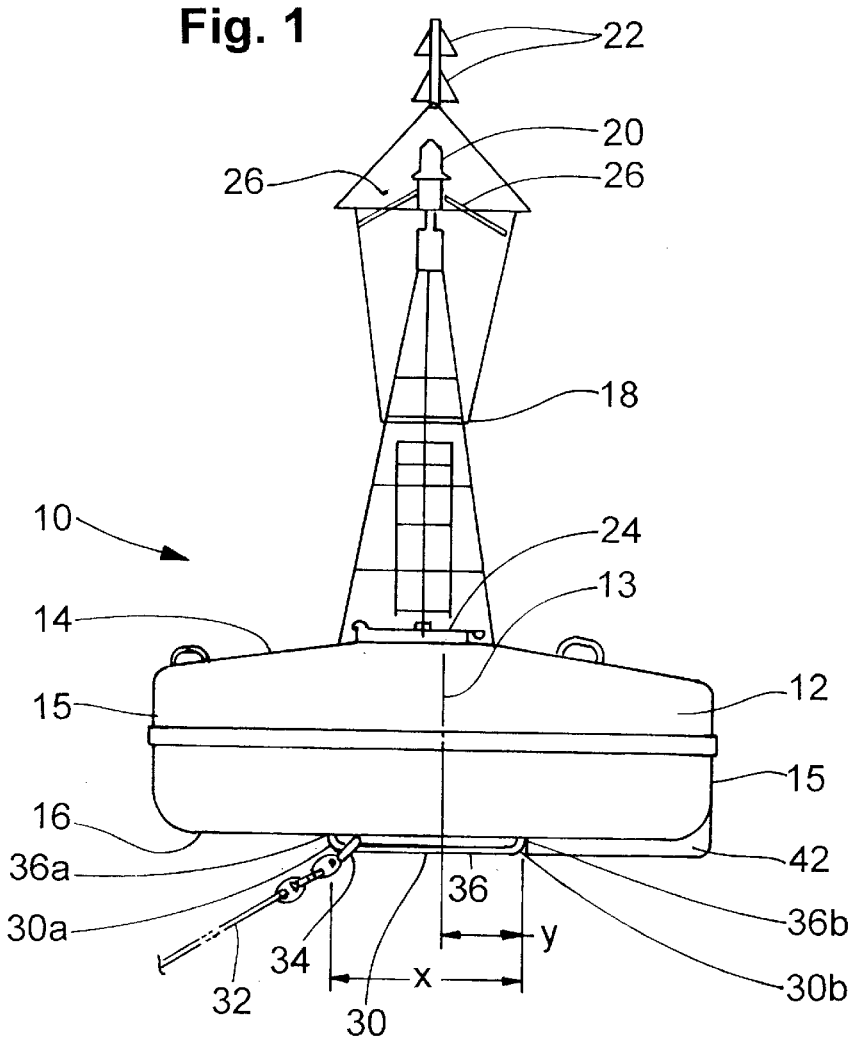
FIG. 1 is a side elevation of a debris shedding buoy in accordance with the present invention.

Certain terminology is used in the following description for convenience only and is not limiting. The words "right," "left," "lower" and "upper" designate directions in the drawings to which reference is made. The words "inwardly" and "outwardly" refer to directions toward and away from, respectively, the geometric center of the debris shedding buoy and designated parts thereof. The terminology includes the words above specifically mentioned, derivatives thereof and words of similar import.

Figure 2:
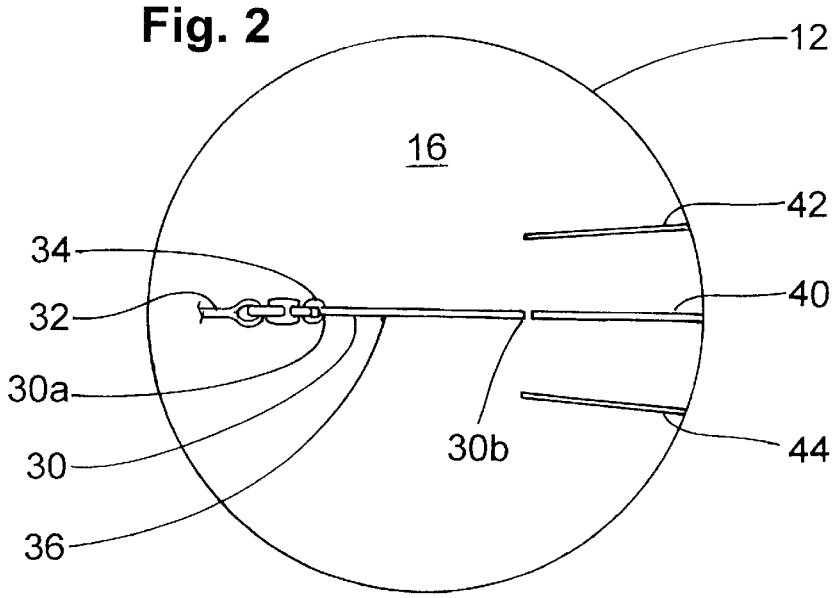
FIG. 2 is a bottom view of the debris shedding buoy of FIG. 1.

Referring to the drawings, wherein like numerals indicate like elements throughout, there is shown in FIGS. 1 and 2 a preferred embodiment of a debris shedding buoy 10 in accordance with the present invention. The buoy 10 includes a float body 12 having a top 14, sides 15 and a bottom 16. A super-structure 18 is affixed to the top 14 of the float body 12. Preferably, a light 20 is supported on top of the super structure 18. Bells 22 are also mounted on top of the superstructure 18.

Preferably, a battery (not shown) is located inside the float body 12 and an access hatch 24 is located on the top 14 of the float body 12 to provide access the battery. The battery is electrically connected to the light 20 and is also preferably connected to solar panels 26 which recharge the battery.

In the preferred embodiment, the float body 12 is disc shaped having a vertical centerline 13, and is approximately 3 meters in diameter and 1.05 meters in height. The super structure 18 extends approximately 3.5 meters above the top 14 of the float body 12. However, it is understood by those of ordinary skill in the art that the size of the buoy 10 may be varied depending upon the particular application. All of this will be known to those of ordinary skill in the art, and accordingly, further description of the float body 12, super-structure 18, light 20, bells 22 and solar panels 26 for recharging the battery is not believed necessary.

A slide rail 30 is attached to the bottom 16 of the float body 12. The slide rail 30 is adapted for slidable engagement to a mooring line 32. The slide rail 30 is located in a generally centered position beneath the float body 12 and is oriented in a first direction, as shown in FIG. 2. The slide rail has a first end 30*a* and a second end 30*b*. A connector 34 is slidably connected to the slide rail 30 and adapted for attachment to the mooring line 32.

Preferably, the slide rail 30 comprises a U-shaped bar 36 and the first and second ends 36*a*, 36*b* are attached to the bottom 16 of the float body 12. Preferably, the bar 36 is made of 25 mm diameter round stock and is preferably made from steel, and is welded to the bottom 16 of the float body 12. The slide rail has a length X, as shown in FIG. 1, of approximately 1.3 meters and the second end 30*b* of the slide rail 30 is located approximately a distance Y of approximately 0.5 meters from the vertical center line 13 of the float body 12. Preferably, the connector 34 is a ring of sufficient size to slide easily along the U-shaped bar 36. It will be understood by those of ordinary skill in the art from the present disclosure that the slide rail 30 can be made from bars having various cross sections, such as a square cross section, and may be attached to the bottom 16 of the float body 12 by various fastening means, such as rivets or threaded fasteners. It will be similarly understood that the slide rail 30 could have a channel-shaped cross section (not shown) with a connector being configured to be slidably disposed within the channel. Those of ordinary skill in the art will recognize that other suitable configurations of a slide rail and a slidable connector which moves along the slide rail are within the broad inventive concept of the present invention. Finally, it will be understood by the ordinarily skilled artisan from the present disclosure that the dimensions X and Y can be varied, if desired, depending upon the buoy configuration.

A rudder device 40, 42, 44 is affixed to the float body 12 and adapted to produce a stabilizing force to maintain the float body 12 in a quasi stable orientation with respect to a current direction, with the first direction along which the slide rail 30 is oriented being generally aligned with the current direction. Preferably, the rudder device comprises a center keel 40 and two rudders 42 and 44. Preferably, the keel 40 and the rudders 42 and 44 have approximately the same profile, and are affixed to the bottom 16 of the float body 12, as shown in FIG. 2. However, it is understood by those of ordinary skill in the art from the present disclosure that the rudder device 40, 42, 44 could be affixed to the sides 15 or top 14 of the float body 12 and extend downwardly.

Preferably, the rudders 42 and 44 are flared outward in opposite directions at a fixed angle from the first direction, with the angle of each rudder 42, 44 being approximately equal such that the rudders 42, 44 are adapted to generate offsetting directional forces with respect to the current that are equal in magnitude to produce the quasi stable orientation of the float body 12. The keel 40 is attached to the bottom 16 of the float body 12 in general alignment with the slide rail 30 and extends outward from the second end 30*b* of the slide rail to a position generally aligned with the side 15 of the float body 12. The two rudders are preferably flared outward in opposite directions at approximately 2° from the first direction to produce the stabilizing force. It will be understood by those of ordinary skill in the art from the present disclosure that a single center keel or rudder can be used alone without the need for the two additional rudders, if desired, or two rudders which are offset at equal and opposite angles from a first direction, such as the rudders 42 and 44, may be used without a center keel. It will be similarly recognized that any suitable type of rudder device may be used which establishes a preferred orientation of the buoy with respect to the current direction.

Any debris lodging against the float body 12 overcomes the stabilizing force created by the rudder device 40, 42, 44, causing the float body 12 to rotate from the quasi stable orientation to a second orientation to shed debris whereupon the float body 12 rotates back to the quasi stable orientation. When the float body 12 rotates from the quasi stable orientation to the second orientation, the connector 34 slides from the first end 30*a* of the slide rail 30 to the second end 30*b* of the slide rail 30 to produce a dislodging force on the float body 12 to assist in shedding the debris, whereupon the float body 12 rotates back to the quasi stable orientation under the stabilizing force created by the rudder device, in the form of the keel 40 and rudders 42 and 44.

In the preferred embodiment, the connector 34 is a double swivel connector which allows the float body 12 to rotate without imparting a twist to the mooring line 32.

Figure 3A:
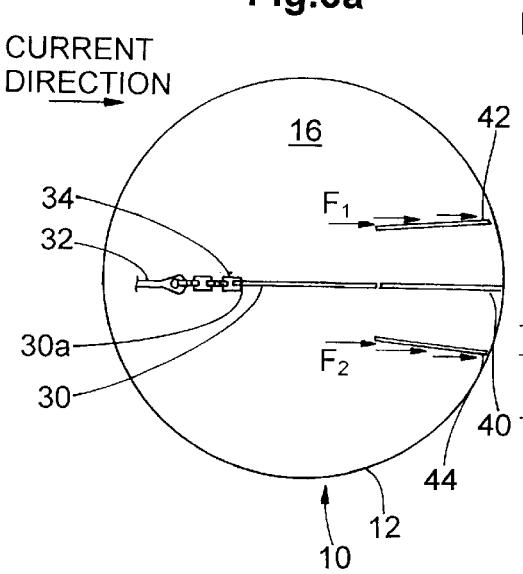
FIGS. 3*a*–3*e* are a sequential series of bottom views of the buoy similar to FIG. 2 illustrating the buoy shedding debris.

The operation of the buoy 10 will now be described with reference to FIGS. 3*a*–3*e*. As shown in FIG. 3*a*, the mooring line 32 is connected to an anchor (not shown) to maintain the buoy 10 in a relatively fixed position with a preferred mooring orientation defined by the rudder device 40, 42, 44 with respect to the current. In the preferred mooring orientation, the bow of the buoy 10, which is the side 15 opposite to the rudder device 40, 42, 44, faces into the current and the connector 34 to the mooring line 32 is located at the first end 30*a* of the slide rail 30. As shown in FIG. 3*a*, the rudders 42 and 44 create quasi stabilizing forces F1 and F2 through the current acting on each rudder 42, 44. F1 and F2 are approximately equal when the buoy is oriented with the first direction (defined by the slide rail 30) being generally aligned with the current direction. If the current direction shifts, the stabilizing force F1 or F2 generated by the rudder 42 or 44 on one side of the buoy becomes greater than the force F1 or F2 generated by the other rudder 42 or 44, causing the float body 12 to rotate back to the preferred mooring orientation. The current also acts on the keel 40 to assist in rotating the float body 12 back to the preferred mooring orientation.

Figure 3B:
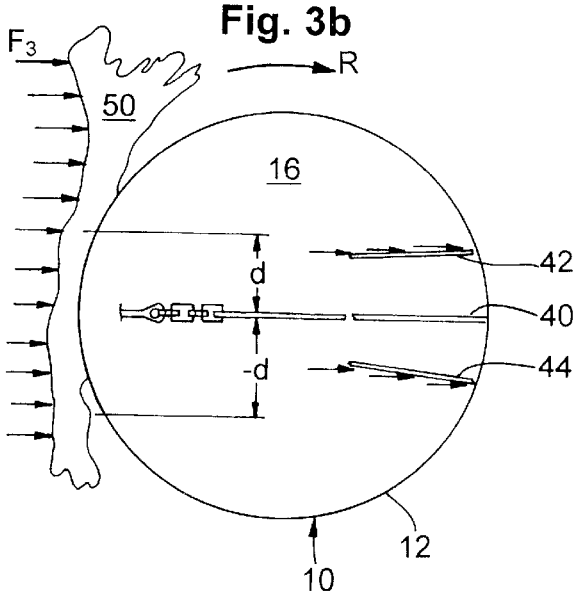

As shown in FIG. 3*b*, if debris 50, such as grass or trash, lodges against the buoy 10, the current acts on the debris 50 creating a rotational force R which is equal to the sum of the products of the current force F3 acting on the debris 50 per unit length and the distance d from the center of the float body 12. When enough debris 50 has accumulated such that the rotational force R overcomes the effect of the forces F1 and F2 of the small rudders 42 and 44, the buoy 10 rotates due to the force F3 of the current acting on the debris 50.

Figure 3C:
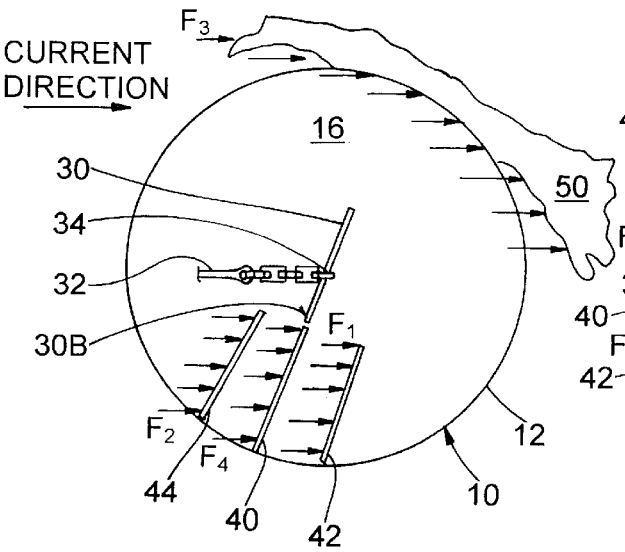

As shown in FIG. 3*c*, when the buoy 10 rotates the stabilizing forces F1 and F2 increase as a function of the angle of each rudder 42, 44 with respect to the current direction, and a stabilizing force F4 is created by the current acting on the keel 40. The stabilizing forces F1, F2 and F4 acting on the rudders 42 and 44, and the keel 40 increase and reach a maximum when the buoy rotates to approximately 90° from the preferred orientation. As the buoy 10 rotates more than 90° from the direction of the current, the connector 34 slides along the slide rail 30 toward the second end 30*b* of the slide rail 30.

Figure 3D:
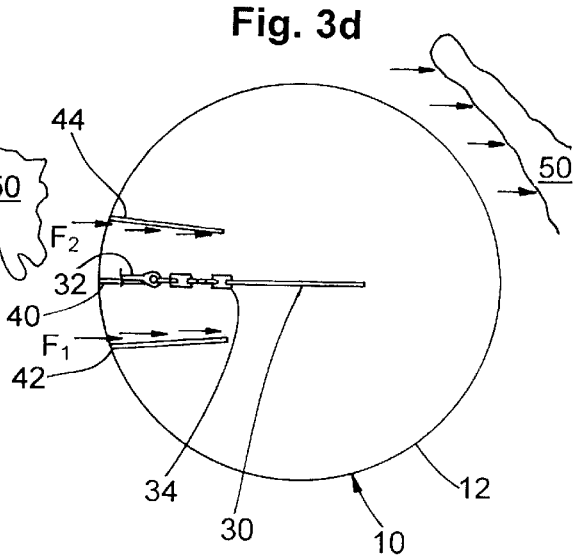
Figure 3E:
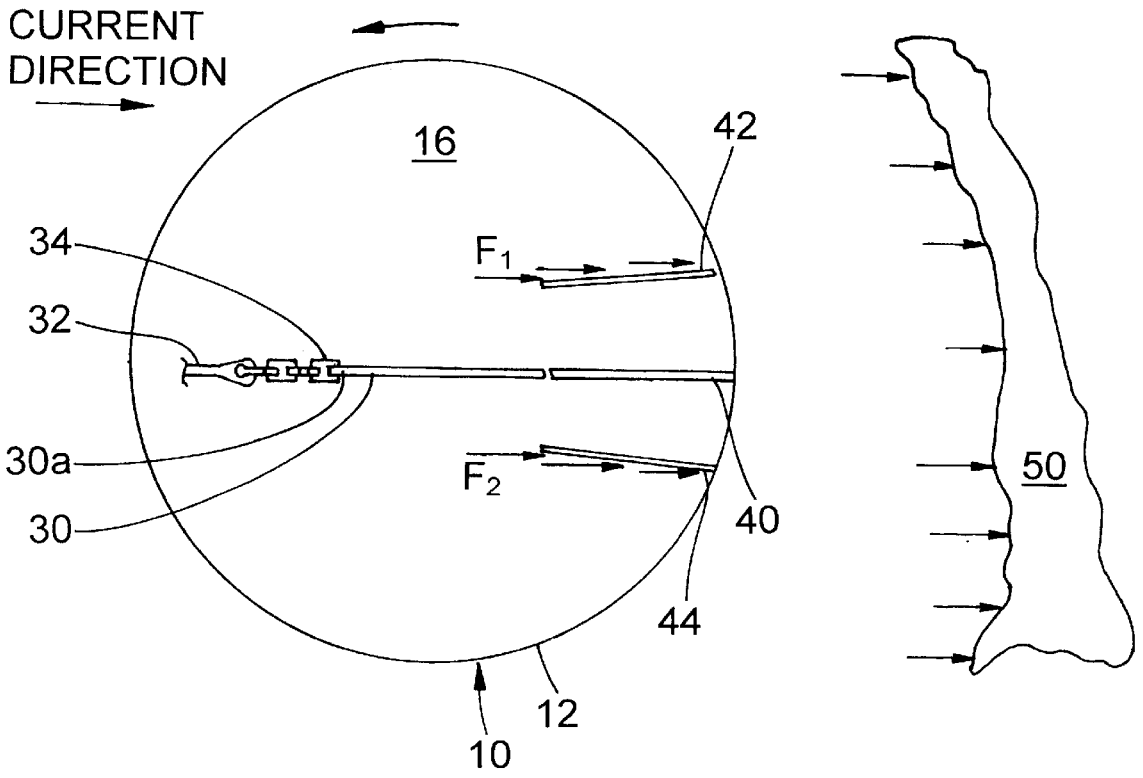

The buoy 10 continues to rotate toward the position shown in FIG. 3*d*, with stern of the float body 12 and the rudders 42, 44 pointed into the current. At any point in the rotation of the buoy 10, the debris 50 may become dislodged and shed from the buoy 10, and the buoy 10 will rotate back to the quasi stable position, as shown in FIG. 3*e*. However, the debris 50 will generally shed as the buoy 10 rotates between 90° and 180° from the preferred mooring orientation. At any point in the rotation past the first 2°, each rudder's force F1 and F2, as well as the keel's force F4 is additive. Once the debris 50 sheds, the force of the current on the rudders 42, 44 and the keel 40 causes the buoy 10 to twist back to its preferred mooring orientation with the bow facing into the current, as shown in FIG. 3*e*, shedding the debris 50. If the buoy rotates exactly 180° as it sheds the debris 50, the buoy 10 reaches an unstable equilibrium at the position shown in FIG. 3*d*, with the forces F1 and F2 of the rudders 42 and 44 being equal. Any slight change in the current direction will destabilize the buoy 10 and it will rotate 180° back to the quasi stable preferred orientation shown in FIG. 3*e*.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

We claim:

1. A debris shedding buoy comprising:

a float body having a top and a bottom;

a slide rail adapted for slidable engagement to a mooring line attached to the bottom of the float body, the slide rail being located in a generally centered position beneath the float body and being oriented in a first direction;

a rudder device affixed to the float body and adapted to produce a stabilizing force to maintain the float body in a quasi stable orientation with respect to a current direction, with the first direction being generally aligned to the current direction, wherein debris lodging against the float body overcomes the stabilizing force, causing the float body to rotate from the quasi stable orientation to a second orientation to shed the debris whereupon the float body rotates back to the quasi stable orientation.

2. The buoy of claim 1 wherein the rudder device comprises two rudders.

3. The buoy of claim 2 wherein the rudders are flared outward in opposite directions at a fixed angle from the first direction, the angle of each rudder being approximately equal such that the rudders are adapted to generate offsetting directional forces with respect to the current that are equal in magnitude to produce the quasi stable orientation of the float body.

4. The buoy of claim 1 wherein the slide rail has a first end and a second end, and further comprising a connector slidably connected to the slide rail and adapted for attachment to the mooring line, such that when the float body rotates from the quasi stable orientation to the second orientation, the connector slides from the first end of the slide rail to the second end of the slide rail to produce a dislodging force on the float body to assist in shedding the debris.

5. The buoy of claim 1 wherein the connector is a double swivel connector.

6. The buoy of claim 1 wherein the slide rail comprises a U-shaped bar having first and second ends, the first and second ends being attached to the bottom of the float body.

7. A debris shedding buoy comprising:

a float body having a top and a bottom;

a slide rail attached to the bottom of the float body, the slide rail being located in a generally centered position beneath the float body and being oriented in a first direction, the slide rail including first and second ends;

a connector slidably connected to the slide rail and adapted for attachment to a mooring line;

a dual rudder device affixed to the float body and adapted to produce a stabilizing force to maintain the float body in a quasi stable orientation with respect to a current direction, with the first direction being generally aligned with the current direction and the connector being positioned at the first end of the slide rail, wherein debris lodging against the float body overcomes the stabilizing force, causing the float body to rotate from the quasi stable orientation to a second orientation wherein the connector slides from the first end of the slide rail to the second end of the slide rail to produce a dislodging force on the float body to assist in shedding the debris, whereupon the float body rotates back to the quasi stable orientation.

8. The buoy of claim 7 wherein the slide rail comprises a U-shaped bar having first and second ends, the first and second ends being attached to the bottom of the float body.

9. A debris shedding buoy comprising:

a float body having a bottom;

a slide rail attached to the bottom of the float body, the slide rail including first and second ends and being located in a generally centered position and oriented in a first direction beneath the float body;

a connector slidably connected to the slide rail and adapted for attachment to a mooring line;

a keel attached to the bottom of the float body, the keel being in general alignment with the slide rail and extending outward from the second of the slide rail two rudders affixed to the bottom of the float body, the rudders being flared outward in opposite directions at approximately 2° from the first direction.

* * * * *